US010612174B2

(12) United States Patent
Muthanandam et al.

(10) Patent No.: US 10,612,174 B2
(45) Date of Patent: Apr. 7, 2020

(54) TOP COVER WITH WASH ACTIVATED PATTERNING

(71) Applicant: Standard Textile Co., Inc., Cincinnati, OH (US)

(72) Inventors: Saravan Muthanandam, Mason, OH (US); Richard Stewart, Mason, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 188 days.

(21) Appl. No.: 13/671,342

(22) Filed: Nov. 7, 2012

(65) Prior Publication Data

US 2014/0123387 A1 May 8, 2014

(51) Int. Cl.

| | |
|---|---|
| ***A47G 9/00*** | (2006.01) |
| ***D06C 23/00*** | (2006.01) |
| ***D03D 15/08*** | (2006.01) |
| ***D03D 15/00*** | (2006.01) |
| ***D03D 15/04*** | (2006.01) |
| ***A47G 9/02*** | (2006.01) |

(52) U.S. Cl.

CPC ..... *D06C 23/00* (2013.01); *A47G 9/0284* (2013.01); *D03D 15/0027* (2013.01); *D03D 15/04* (2013.01); *D03D 15/08* (2013.01); *D10B 2331/04* (2013.01)

(58) Field of Classification Search

CPC ..... D06C 23/00; D06C 23/04; D03D 15/04; D03D 15/08; D03D 15/0027; A47G 9/00–04; A47G 11/00; A47G 11/003–008

USPC ..... 442/181, 182, 184, 189, 197, 199, 203, 442/208, 209, 213, 214, 216, 217, 220, 442/301, 21, 7; 428/357, 364, 365, 373, 428/374; 5/482–502; 28/167

See application file for complete search history.

(56) References Cited

U.S. PATENT DOCUMENTS

| | | | |
|---|---|---|---|
| 6,367,082 | B1 | 4/2002 | Mina |
| 7,526,816 | B2 | 5/2009 | Shak |
| 7,673,656 | B2 | 3/2010 | Heiman |
| 8,230,537 | B2 | 7/2012 | Stewart et al. |
| 2002/0098759 | A1 | 7/2002 | Salway et al. |
| 2003/0028950 | A1 | 2/2003 | Walsh |

(Continued)

FOREIGN PATENT DOCUMENTS

| | | | |
|---|---|---|---|
| EP | 1061165 | A2 | 12/2000 |
| EP | 1336674 | A1 | 8/2003 |

OTHER PUBLICATIONS

Celanese, Complete Textile Glossary, 2001.*

(Continued)

*Primary Examiner* — Jeremy R Pierce

(74) *Attorney, Agent, or Firm* — Wood Herron & Evans LLP

(57) ABSTRACT

A top cover comprises a woven web of warp yarns and fill yarns, with a first plurality of the fill yarns (and/or the warp yarns) being non-spandex, non-core spun elastomeric yarns and a second plurality of the fill yarns (and/or the warp yarns) being non-elastomeric yarns whereby the top cover has a wash activated patterning so as to have a bulky look or texture after it is laundered, especially the first time it is laundered, which allows the top cover to serve as a top cover without the need for additional processing such as ironing or pressing.

19 Claims, 3 Drawing Sheets

(56) References Cited

U.S. PATENT DOCUMENTS

| | | | | |
|---|---|---|---|---|
| 2006/0180229 | A1 | 8/2006 | Heiman | |
| 2009/0191777 | A1 | 7/2009 | Liao | |
| 2009/0193584 | A1 | 8/2009 | Stewart et al. | |
| 2014/0123362 | A1* | 5/2014 | Seitz et al. | 2/69 |

OTHER PUBLICATIONS

International Search Report and Written Opinion issued by the European Patent Office for PCT Application No. PCT/US2013/065646, dated Apr. 16, 2014 (12 pages).
Declaration of Richard Stewart dated May 29, 2013 (3 pages).

* cited by examiner

TOP COVER WITH WASH ACTIVATED PATTERNING

FIELD OF THE INVENTION

The present invention relates to top covers for use on a bed mattress made up with linens such as in place of a bed spread.

BACKGROUND

Typical bed spreads are placed over a bed mattress that has been made up with linen sheets, such as one-ply fitted and flat sheets. But bed spreads, particularly styles that are filled and/or quilted, are much heavier and bulkier than the typical thin, light linen sheets they are placed over. As a result, when a person gets into the made-up bed, if the bed spread is still over the linen sheets, the person might be uncomfortable. Also, in the hospitality field, such as for hotels and motels, the heavy bed spreads represent costs in handling and laundering that are higher than the costs associated with handling and laundering of the linen sheets. To reduce these concerns, many in the hospitality industry have begun to use top covers in place of bed spreads over the made-up bed mattress. Current top covers, while still thicker and heavier than linen sheets, are lighter and thinner than the bed spreads they replace. They are thus less uncomfortable to someone in the bed and have reduced handling and laundering cost as compared to bed spreads. But they still require additional processing beyond just washing, such as ironing and pressing. Those additional processing steps add costs as well.

SUMMARY OF THE INVENTION

The present invention provides a top cover that avoids the need for additional processing, such as ironing and pressing, to serve as a top cover for use on a bed mattress made up with linen sheets. To that end, and in accordance with the principles of the present invention, the top cover is a woven web comprising warp yarns and fill yarns, where at least the fill yarns or the warp yarns of the woven web include a first plurality of non-spandex, non-core spun elastomeric yarns and a second plurality of non-elastomeric yarns. The elastomeric yarns will shrink or crinkle more when laundered than will the non-elastomeric yarns to provide a wash activated patterning to the woven web. Advantageously, the wash activated patterning is provided after the first laundering. As a result, the sheeting-like woven web will have a permanent and irreversible textured/wrinkled pattern. The wash activated patterning thus provides a bulky look or texture sufficient to provide the look and feel of a top cover, without the bulk of a bed spread, while providing a functional and attractive decorative element to the bed make-up absent any need for ironing or pressing. The construction of the top cover has the further advantage that it is lighter than either bed spreads or current top covers so as to have the lightness and advantages of a linen sheet.

The fabric web is advantageously plain woven in an approximately 4 oz. per square yard fabric. The amount of non-elastomeric yarns to elastomeric yarns in the warp or in the fill may be in a ratio that is advantageously a multiple of 4:1, such as 4:1 or 12:3, although other ratios could be selected. Further, the insertion pattern of the elastomeric and non-elastomeric yarns may be alternating as respective clusters of the non-elastomeric yarn and of the non-spandex, non-core spun elastomeric yarn. The fabric web is cut into a generally rectangular configuration, and hemmed, in dimensions suitable for use as a top cover over a bed mattress made up with linen sheets. The fabric web (in the greige state before being made up into the top cover) or the top cover after it is made, but before being delivered to a customer, may be laundered to obtain the wash activated patterning.

Where the fill yarns are the elastomeric and non-elastomeric yarns, the warp yarns may be any typical yarns, such as cellulose-containing, synthetic, or a combination thereof, which may be cotton, cotton/poly, or polyester, an advantageous example of which is 50% cotton/50% poly spun yarn. Where the warp yarns are the elastomeric and non-elastomeric yarns, the fill yarns may be the typical yarns, such as cellulose-containing, synthetic, or a combination thereof. Or the warp and fill yarns might each be the elastomeric and non-elastomeric yarns. The elastomeric and non-elastomeric yarns are advantageously a combination of 100% polyester multifilaments yarns. In that regard, the non-elastomeric yarns may be synthetic filament yarns, such as PET polyester, although other yarns could be used provided they have less shrink as compared to the elastomeric yarns. The non-spandex, non-core spun elastomeric yarns may be a bi-component polyester textile fiber which may include PTT and PET polyester, such as elasterell-p.

By virtue of the foregoing there is thus provided a top cover that avoids the need for additional processing, such as ironing and pressing, to serve as a top cover for use on a bed mattress made up with linen sheets. These and other advantages of the present invention shall be made apparent from the accompanying drawings and the description thereof.

BRIEF DESCRIPTION OF THE DRAWINGS

The accompanying drawings, which are incorporated in and constitute a part of this specification, illustrate an embodiment of the invention and together with the general description of the invention given above and the detailed description of the embodiment given below, serve to explain the principles of the present invention.

DETAILED DESCRIPTION OF THE DRAWINGS

Figure 1:
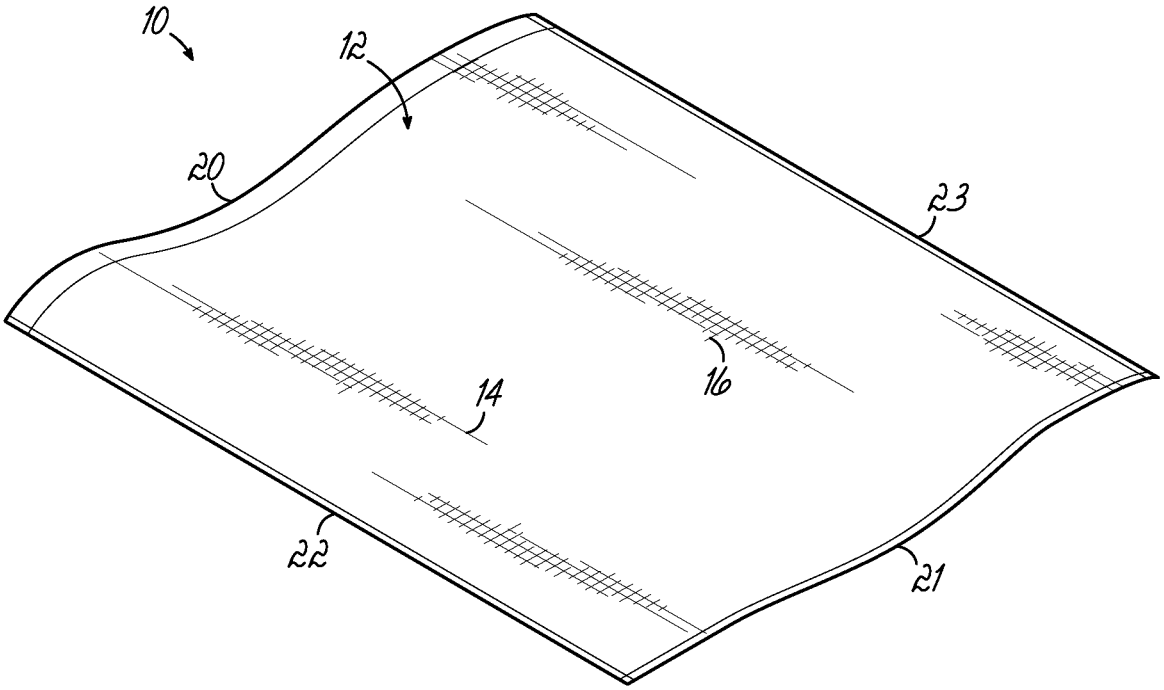
FIG. 1 is a perspective view of a top cover constructed in accordance with the principles of the present invention.
Figure 2:
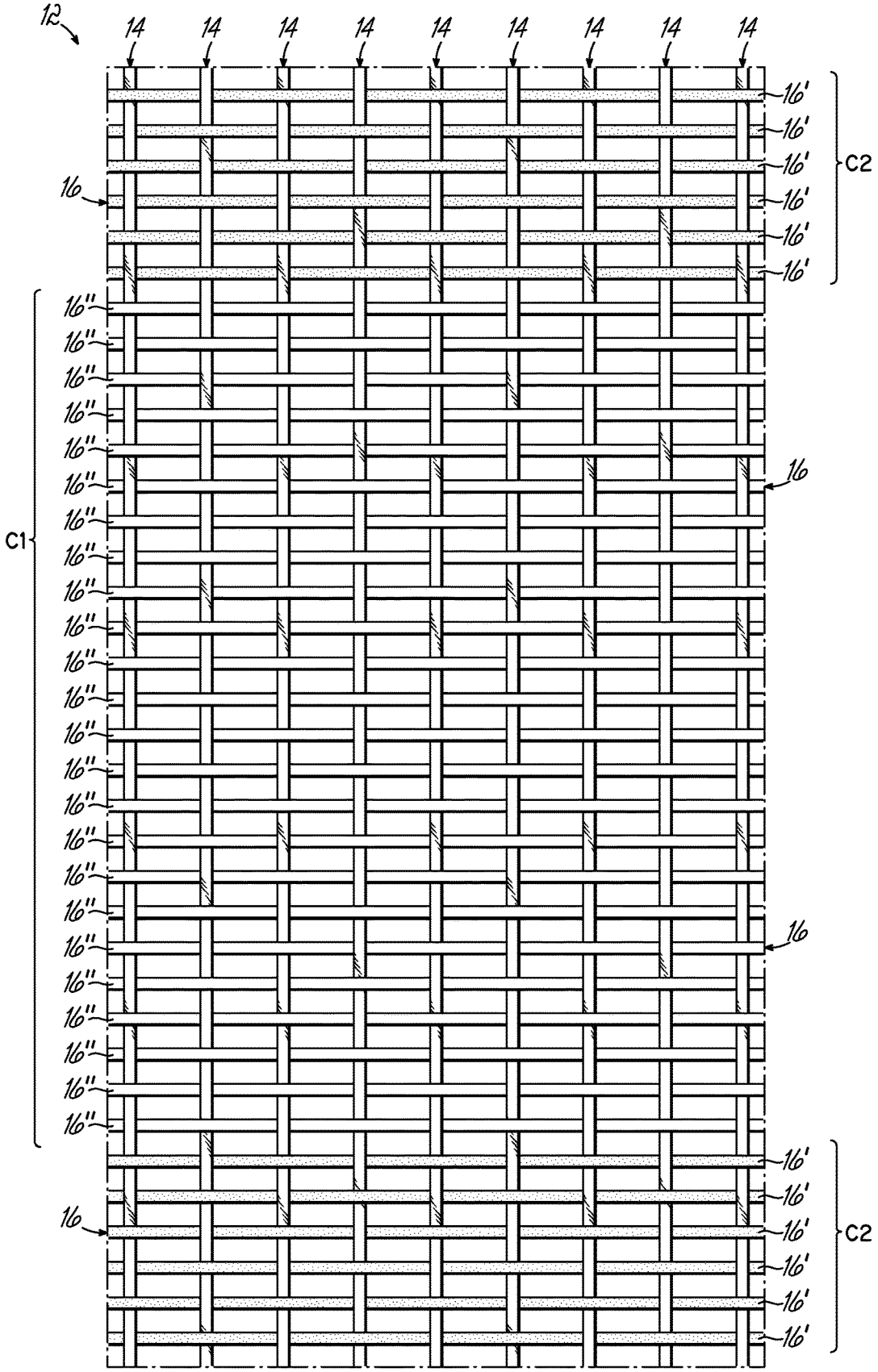
FIG. 2 is an exploded view, not to scale, of a portion of the fabric web of the top cover of FIG. 1.

With reference to the FIG. 1, there is shown a perspective view of a top cover, also referred to as a bed cover or a bed top cover, 10 in accordance with the principles of the present invention. With further reference to FIG. 2, top cover 10 is comprised of a fabric woven web 12 of warp yarns 14 and fill yarns 16, wherein a first plurality of the fill yarns 16 are non-spandex, non-core spun elastomeric yarns 16' and a second plurality of the fill yarns 16 are non-elastomeric yarns 16". The warp yarns 14 may be cellulose-containing, synthetic, or a combination thereof.

In one embodiment, the fill yarns 16 are a combination of 100% polyester multifilament yarns, a first plurality thereof 16' as previously described being the non-spandex, non-core spun elastomeric yarns, and a second plurality 16" being non-elastomeric synthetic filament yarns. While the yarns 16' may be any non-spandex, non-core spun elastomeric synthetic, they may be a bi-component polyester textile fiber, such as 150 denier elasterell-p, which is a combination of PET and PTT polyester. The yarns 16" may be any non-elastomeric synthetic filament yarn, but one advantageous yarn is 150 denier PET polyester. In that embodiment, the warp yarns may be selected from the group consisting of cotton, cotton/poly, and polyester, and may advantageously be 50% cotton/50% poly spun yarn.

Woven web 12 is advantageously plain woven in an approximately 4 oz. per square yard. And the amount of yarns 16" to yarns 16' may be in a ratio that is advantageously a multiple of 4:1, such as 4:1 or 12:3, although other ratios could be selected. Further, the insertion pattern of the yarns 16 may be alternating as a cluster C1 of the non-elastomeric yarns 16" and a cluster C2 of the non-spandex, non-core spun elastomeric yarns 16'. While only one cluster C1 and two clusters C2 are shown in FIG. 2, it will be appreciated that there will be a number of such alternating clusters in the woven web 12.

Figure 3:
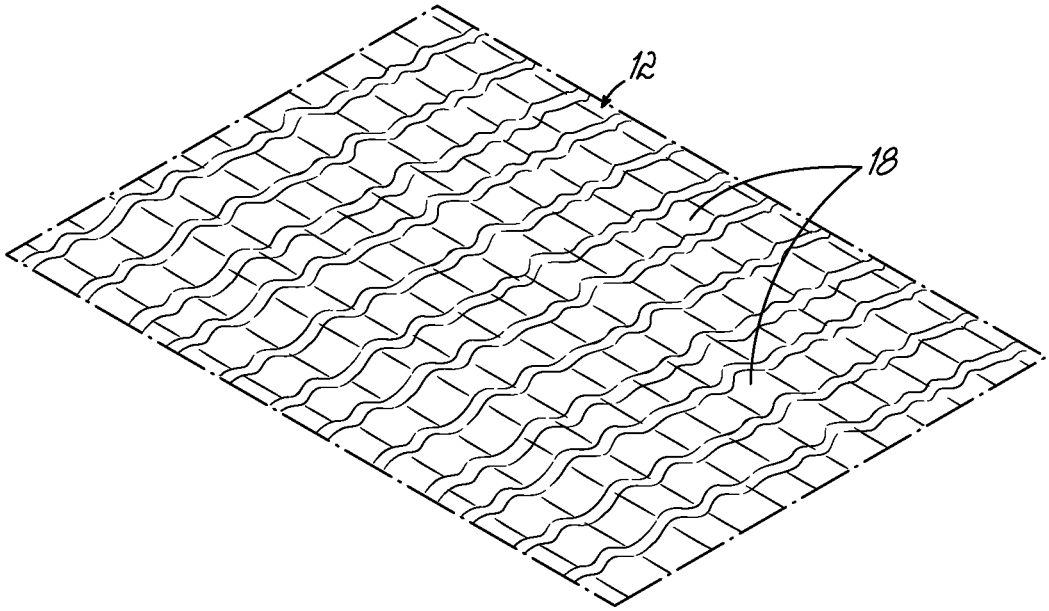
FIG. 3 is another, but less exploded view, not to scale of a portion of the fabric web of the top cover of FIG. 1 showing the wash activated patterning for purposes of explaining the principles of the present invention.

With further reference to FIG. 3, the non-spandex, non-core spun elastomeric yarns 16', such as the elasterall-p, will shrink or crinkle more when laundered than will the non-elastomeric yarns 16". That results in a wash activated patterning to the woven web 16 giving it a permanent and irreversible textured/wrinkled pattern, as at 18.

Figure 4:
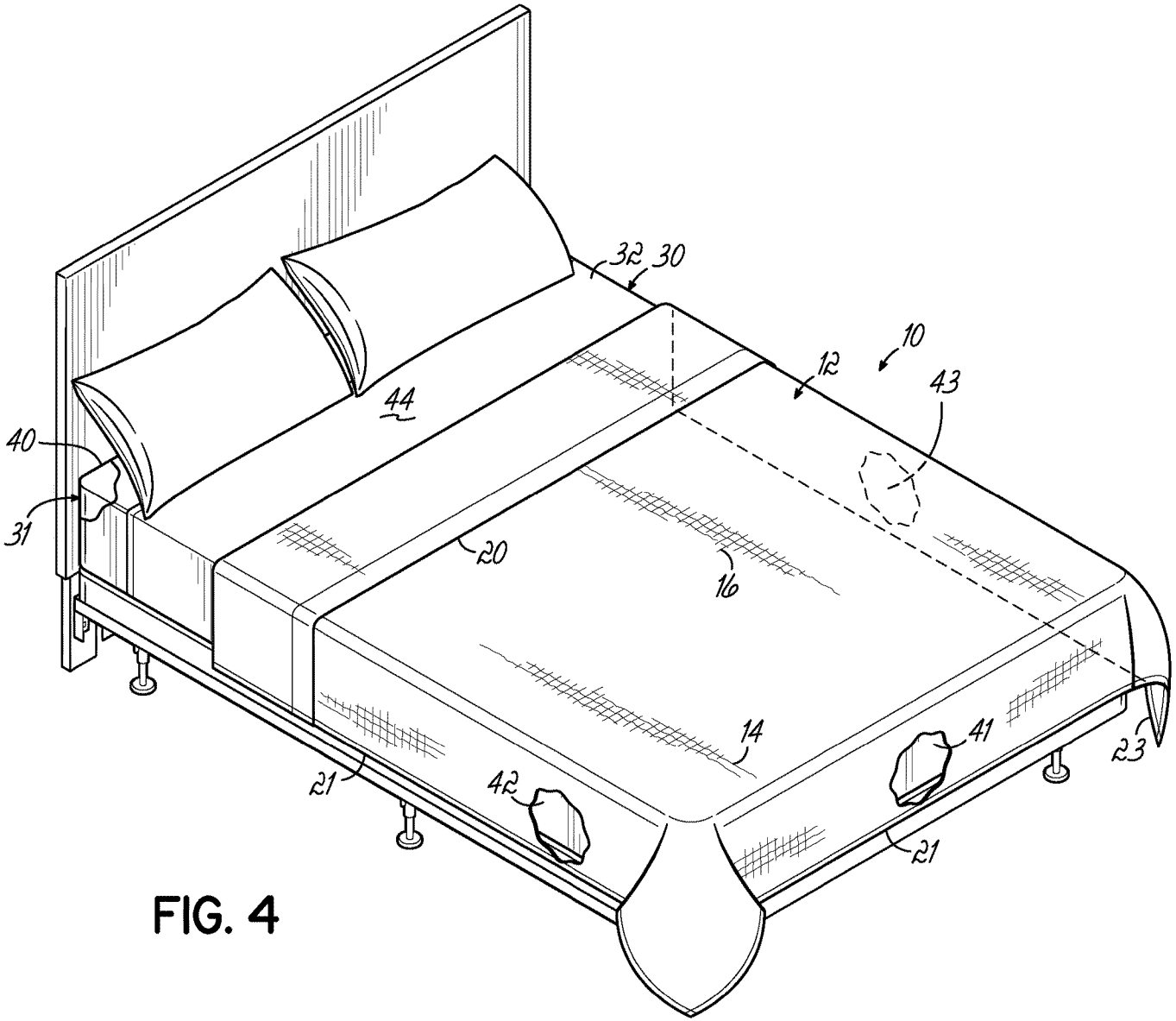
FIG. 4 is perspective view of the top cover of FIG. 1 situated on a bed mattress made up with linen sheets.

The woven web 12 is cut and formed into a rectangular configuration and hemmed to form a top hem 20, bottom hem 21, left side hem 22, and right side hem 23 along the respective edges thereof as seen in FIG. 1. Top hem 20 may be wider than the other hems 21, 22, and 23. The top cover 10 is cut, formed, and hemmed to have a dimension suitable for use over a made-up bed mattress 30 (i.e., a bed mattress 31 made up with one or more linen sheets 32) as seen in FIG. 4. The textured/wrinkled pattern 18 provides a bulky look or texture sufficient to provide top cover 10 the desired look and feel as a top cover, without the bulk of a bed spread, while providing a functional and attractive decorative element to the made-up bed mattress 30 absent any need for ironing or pressing of the top cover 10. The construction of the top cover 10 has the further advantage that it is lighter than either bed spreads or current top covers so as to have the lightness and advantages of a linen sheet.

A method of forming the top cover 10 includes weaving and/or obtaining the woven web 12; cutting or otherwise forming it into a rectangular configuration slightly larger than the desired dimension so as to be of a size near that desired to go over the made-up bed mattress 30; folding over excess portions along each edge; and hemming the folded over portions to form the hem 20, 21, 22, and 23 as a top cover 10 of a dimension suitable for use as a top cover over the made-up bed mattress 30 (FIG. 4). Advantageously, the length of top cover 10 between top and bottom hems 20 and 21, and the width between the side hems 23 and 23, is longer than a length of the bed mattress 31 between its top and bottom ends 40, 41 and wider than the width of the bed mattress 31 between its left and right sides 42, 43, respectively. As a consequence, with the top cover 10 placed over the upper surface 44 of the made-up bed mattress 30, the top hem 20 is at or adjacent to the mattress top end 40 (either right at the top end 40 or folded back over part of the woven web 12 to be spaced a bit away from top end 40, as seen in FIG. 4), while the bottom hem 21 and the side hems 22 and 23, are situated past and below the bottom end 41 and the sides 42, 43, respectively, of the mattress 31.

The woven web 12 may be laundered prior to forming the top cover 10, such as in the greige state (before forming into a rectangular configuration), in order to provide a wash activated patterning, or it may be laundered after being formed into the top cover 10 for that purpose.

In use, and with reference to FIG. 4, the bed mattress 31 will be made up with one or more linen sheets 32, such as a fitted sheet and/or a plain or flat sheet (only one sheet 32 shown in FIG. 4), and possibly even a blanket or the like (not shown). The top cover 10 will then be placed over the upper surface 44 of the made-up bed mattress 30, with the top hem 20 near or adjacent to the top end 40 (either right at the top end 40 or folded back over part of the woven web 12 to be spaced a bit away from top end 40, as seen in FIG. 4), and the top, left and right hems 21, 22, and 23 extending down below the upper surface 44, and advantageously, past and below the bottom end 41 and sides 42, 43.

By virtue of the foregoing there is thus provided a top cover 10 that avoids the need for additional processing, such as ironing and pressing, to serve as a top cover for use on a bed mattress made up with linen sheets is lighter and thinner than either bed spreads or current top covers to thus provide the advantages of linen sheets, while still able to serve as a top cover for use on a bed mattress made up with linen sheets.

While the present invention has been illustrated by a description of a particular embodiment thereof, and while the embodiment has been described in some detail, it is not intended to restrict or in any way limit the scope of the appended claims to such detail. Additional advantages and modifications will readily appear to those skilled in the art. By way of example, while the embodiment is described with reference to the elastomeric yarns 16' and non-elastomeric yarns 16" comprising the fill yarns 16, alternatively or additionally, the warp yarns 14 could be comprised of such elastomeric and non-elastomeric yarns. Additionally, while fill yarns 16" are advantageously non-elastomeric synthetic filament yarns, they could be natural yarns, or a blend of natural and synthetic yarns, provided they have less shrink as compared to the elastomeric yarns 16' to thus provide a wash activated patterning. The invention in its broader aspects is therefore not limited to the specific details, representative apparatus and method shown and described. Accordingly, departures may be made from such details without departing from the scope or spirit of the general inventive concept.

Having described the invention, what is claimed is:

1. A top cover for use over a made-up bed mattress, the top cover comprising a woven web of warp yarns and fill yarns in a rectangular configuration and hems so as to be of a size to be used over a made-up bed mattress, the warp yarns or the fill yarns including a first cluster of a first plurality of non-spandex, non-core spun elastomeric yarns in a side-by-side arrangement and a second cluster of a second plurality of non-elastomeric yarns in a side-by-side arrangement, wherein the warp yarns or fill yarns comprise an alternating sequence of the first and second clusters, wherein the number of yarns in each second cluster is a multiple of the number of yarns in each first cluster, whereby the first clusters of non-spandex, non-core spun elastomeric yarns will shrink more when laundered than the second clusters of non-elastomeric yarns to provide a top cover having a wash activated patterning so as to have a bulky look or texture.

2. The top cover of claim 1, the first and second plurality of yarns being fill yarns.

3. The top cover of claim 2, the warp yarns being cellulose-containing, synthetic, or a combination thereof.

4. The top cover of claim 1, the first and second plurality of yarns being warp yarns.

5. The top cover of claim 4, the fill yarns being cellulose-containing, synthetic, or a combination thereof.

6. The top cover of claim 1, both the warp yarns and the fill yarns each include a respective first plurality of non-spandex, non-core spun elastomeric yarns and a second plurality of non-elastomeric yarns.

7. The top cover of claim 1, the second plurality of non-elastomeric yarns and first plurality of elastomeric yarns being present in the woven web in a ratio of about 4:1.

8. The top cover of claim 1, the non-elastomeric yarns being synthetic filament yarns.

9. A method of forming a top cover comprising:

obtaining a woven web of warp yarns and fill yarns with the warp yarns or the fill yarns including a first cluster of a first plurality of non-spandex, non-core spun elastomeric yarns and a second cluster of a second plurality of non-elastomeric yarns, wherein the warp yarns or the fill yarns comprise an alternating sequence of the first and second clusters;

forming a rectangular configuration from the woven web of a size near that desired to go over a made-up bed mattress;

hemming respective edges of the woven web; and laundering the woven web whereby to obtain a wash activated patterning defining a bulky look or texture.

10. The method of claim 9 wherein the laundering occurs after the hemming.

11. The method of claim 9 further comprising obtaining a woven web of warp yarns and fill yarns wherein only the fill yarns include the first plurality of non-spandex, non-core spun elastomeric yarns and the second plurality of non-elastomeric yarns.

12. The method of claim 11 further comprising obtaining a woven web of warp yarns and fill yarns wherein the warp yarns are cellulose-containing, synthetic, or a combination thereof.

13. The method of claim 9 further comprising obtaining a woven web of warp yarns and fill yarns wherein only the warp yarns include the first plurality of non-spandex, non-core spun elastomeric yarns and the second plurality of non-elastomeric yarns.

14. The method of claim 13 further comprising obtaining a woven web of warp yarns and fill yarns wherein the fill yarns are cellulose-containing, synthetic, or a combination thereof.

15. The method of claim 9 further comprising obtaining a woven web of warp yarns and fill yarns wherein both the fill yarns and the warp yarns include a respective first plurality of non-spandex, non-core spun elastomeric yarns and second plurality of non-elastomeric yarns.

16. A method of forming a top cover comprising:

obtaining an already laundered woven web of warp yarns and fill yarns with the warp yarns or the fill yarns including a first cluster of a first plurality of non-spandex, non-core spun elastomeric yarns and a second cluster of a second plurality of non-elastomeric yarns, wherein the warp yarns or the fill yarns comprise an alternating sequence of the first and second clusters so as to have a wash activated patterning defining a bulky look or texture;

forming a rectangular configuration from the woven web of a size near that desired to go over a made-up bed mattress; and hemming respective edges of the woven web.

17. A method of forming a top cover comprising:

weaving warp and fill yarns into a woven web of warp yarns and fill yarns with the warp yarns or the fill yarns including a first cluster of a first plurality of non-spandex, non-core spun elastomeric yarns and a second cluster of a second plurality of non-elastomeric yarns, wherein the warp yarns or the fill yarns comprise an alternating sequence of the first and second clusters;

forming a rectangular configuration from the woven web of a size near that desired to go over a made-up bed mattress;

hemming respective edges of the woven web; and laundering the woven web whereby to obtain a wash activated patterning defining a bulky look or texture.

18. The method of claim 17 wherein the laundering occurs after the hemming.

19. The method of claim 17 wherein the laundering occurs before the forming.

* * * * *